United States Patent [19]

Whittington

[11] Patent Number: 5,033,657

[45] Date of Patent: Jul. 23, 1991

[54] ADJUSTABLE STROKE PUMP DISPENSER

[75] Inventor: Jimmie L. Whittington, Diamond Bar, Calif.

[73] Assignee: James River Corporation, Oakland, Calif.

[21] Appl. No.: 544,694

[22] Filed: Jun. 27, 1990

[51] Int. Cl.[5] ..... B67D 5/06

[52] U.S. Cl. ..... 222/309; 222/181

[58] Field of Search ..... 222/105, 181, 183, 185, 222/207, 287, 309, 321, 340, 383

[56] References Cited

U.S. PATENT DOCUMENTS

| | | | |
|---|---|---|---|
| 2,605,021 | 7/1952 | Churchill et al. | 222/304 X |
| 4,018,363 | 4/1977 | Cassia | 222/181 X |
| 4,146,156 | 3/1979 | Cassia | 222/181 |
| 4,673,109 | 6/1987 | Cassia | 222/181 X |
| 4,978,036 | 12/1990 | Burd | 222/207 |

FOREIGN PATENT DOCUMENTS

| | | | |
|---|---|---|---|
| 2727679 | 11/1978 | Fed. Rep. of Germany | 222/181 |

*Primary Examiner*—Kevin P. Shaver
*Assistant Examiner*—Joseph A. Kaufman
*Attorney, Agent, or Firm*—Thomas R. Lampe

[57] ABSTRACT

Apparatus for adjusting the amount of liquid dispensed through a liquid dispenser pump actuated by a bail. The pump includes a movable pump element and structure interconnecting the bail and the pump element including a rocker for imparting movement to the pump element and adjustment mechanism for selectively varying the pivotal movement imparted to the rocker by the bail.

8 Claims, 3 Drawing Sheets

ADJUSTABLE STROKE PUMP DISPENSER

TECHNICAL FIELD

This invention relates to apparatus for dispensing liquid. More particularly, the present invention relates to a bail-operated dispenser for liquid soaps and other types of liquid which incorporates structure allowing for predetermined adjustment of the amount of liquid dispensed without modifying the movement characteristics of the bail.

BACKGROUND ART

It is well known in the art to actuate liquid soap and lotion dispensers by means of a manually-operated bail. It is also known to provide various arrangements in liquid soap and lotion dispensers for adjusting the amount of liquid dispensed therefrom.

Attempts to combine the aforesaid two features in a single dispenser construction have been less than satisfactory. Some prior art approaches employ a mechanism which provides for a reduction of normal output by obstructing or restricting movement of the bail so that it cannot be manually moved as great a distance by the operator as is the case when a full portion of the soap or other liquid is being dispensed. Also, many bail-operated dispensers incorporating means to adjust the outflow of liquid dispensed are characterized by their relative complexity and high cost of manufacture.

DISCLOSURE OF INVENTION

The present invention relates to a relatively simple and inexpensive structural arrangement for dispensing soaps, lotions and other liquids from a container. The apparatus includes a bail which is manually operable to dispense the liquid and additionally incorporates structure which may readily be adjusted to change the quantity of liquid dispensed upon manual actuation of the bail.

Furthermore, regardless of whether the apparatus is set for full dispensing capability or set for dispensing a fractional amount of liquid, movement of the bail is unaffected. That is, under either condition, the bail is manually moved to its full normal extent. This means that the bail has a proper "feel" at all times. And, since movement of the bail is not interrupted when the dispenser is in its partial dispensing mode, there is no danger that the bail and related dispenser mechanism will be broken by a person dispensing the liquid.

The apparatus for dispensing liquid constructed in accordance with the teachings of the present invention includes a container defining an interior for accommodating liquid. Mounting means is provided for mounting the container.

A pump is connected to the container, the pump including a pump element reciprocatable along a predetermined path of movement to dispense liquid from the housing interior.

Actuator means is operatively associated with the pump for moving the pump element along the predetermined path of movement. The actuator means includes manually-operable bail means movable connected to the mounting means and movable from a first position to a second position.

The actuator means further includes rocker means pivotally attached to the mounting means at a pivot point on the rocker means. The rocker means has a first end engageable with the pump element to move the pump element along the predetermined path of movement upon pivotal movement of the rocker means.

Connector means interconnects the bail means and rocker means to impart pivotal movement to the rocker means responsive to movement of the bail means from the first position to the second position.

The connector means includes adjustment means for selectively varying the degree of pivotal movement imparted to the rocker means by the bail means during movement of the bail means from the first position to the second position whereby the distance the pump element is moved along the predetermined path by the rocker means first end when the bail means is moved from the first position to the second position may be selectively varied.

Other features, advantages, and objects of the present invention will become apparent with reference to the following description and accompanying drawings.

BEST MODE FOR CARRYING OUT THE INVENTION

Figure 1:
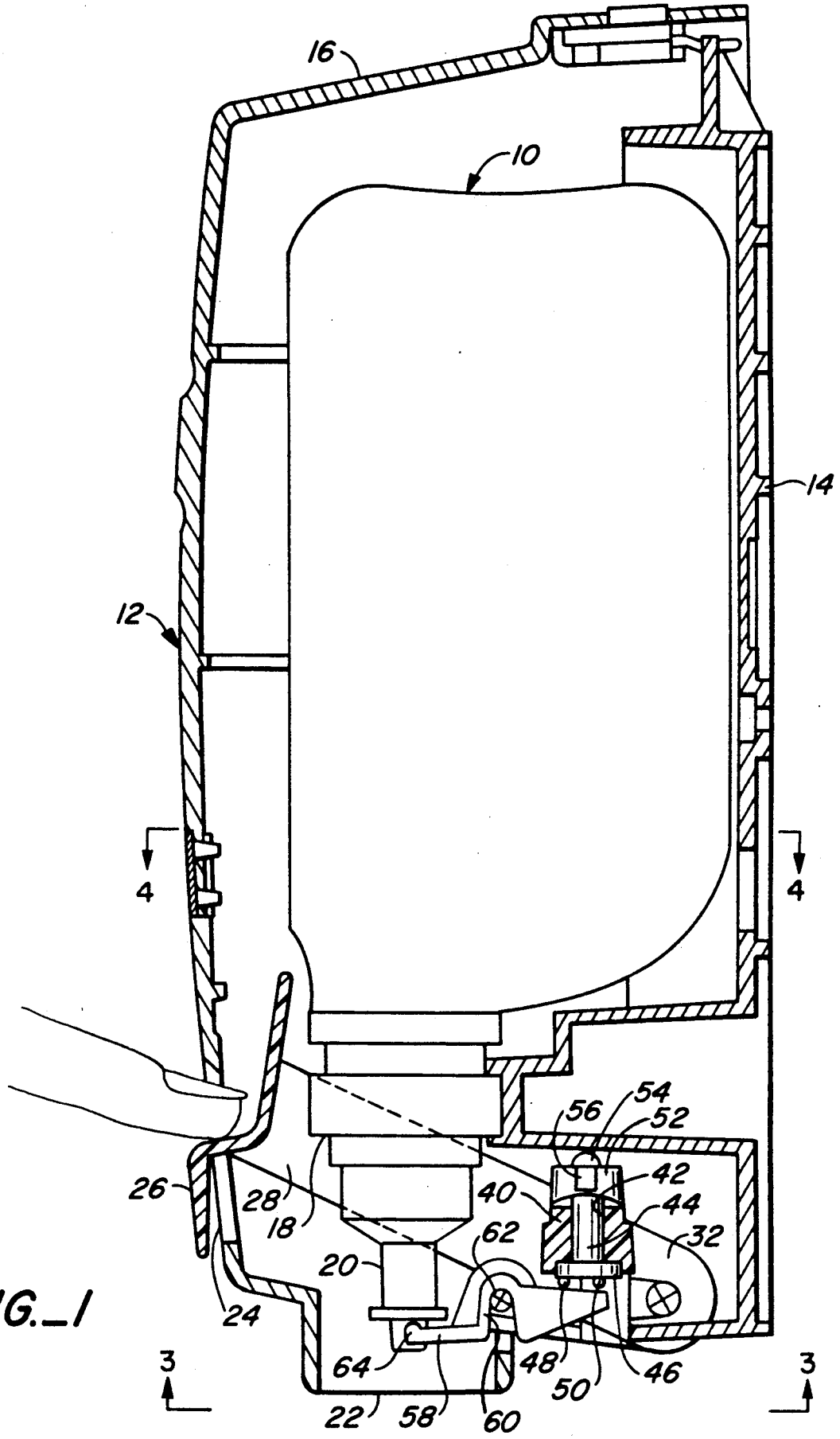
FIG. 1 is a side elevation view, in partial cross-section, of apparatus constructed in accordance with the teachings of the present invention as taken along the line 1—1 in FIG. 3.

Referring now to the drawings, a container 10 is mounted within a housing or cabinet 12. In the arrangement illustrated, the housing 12 includes a mounting member 14 and a cover 16. It will be appreciated that mounting member 14 is attached to a wall or other vertical surface by screws or other fasteners (not shown).

A pump 18 is connected to container 10, said pump including a pump element 20 reciprocatable along a predetermined path of movement to dispense liquid from the housing interior. U.S. Patent No. 4,933,600 discloses a pump which is suitable for use when practicing the present invention; however, it will be appreciated that many prior art liquid dispenser pumps incorporating reciprocal dispenser elements are known in the prior art and that such pumps may also be utilized.

Liquid dispensed from the pump will pass through the pump element 20 and fall under the influence of gravity through an outlet opening 22 formed at the bottom of the housing 12.

Another opening 24 is formed in the front of the housing and projecting therethrough is the distal end 26 of a bail 28. As may be seen, the distal end 26 is shaped for engagement by the finger of a user. Biasing means (not shown) of any suitable nature normally maintains the bail in the position illustrated in FIG. 1.

Such biasing means may be directly connected to the bail or may be incorporated elsewhere in the mechanism. For example, the pump disclosed in the aforementioned U.S. Pat. No. 4,993,600 includes an internally disposed spring which continuously urges the pump element 20 downwardly. As will be seen below, structure interconnecting the bail and pump element 20 will cooperate to urge the bail to the position shown in FIG. 1.

The bail 28 includes two spaced arms 30, 32 which extend into the interior of housing 12. Apertures are formed in the ends of the arms spaced from distal end 26 which accommodate pivot pins 34, 36. Pins 34, 36 may, as shown, also provide for the pivotal attachment of cover 16 to mounting member 14 so that the cover may be selectively opened and closed to provide access to the interior of the housing. In any event, it will be appreciated that pins 34, 36 pivotally mount the bail 28 to the housing.

A first connector element in the form of cross piece 40 interconnects arms 30, 32 intermediate the pivot pins and distal end 26. The cross piece defines a throughbore 42. Positioned for rotatable movement relative to the cross piece within throughbore 42 is a shaft 44. A disk 46 is attached to the lower end of the shaft and rotatably slidably disposed within a circular-shaped recess formed in the bottom of the cross piece 40. Two projections 48, 50 project downwardly from the disk.

The upper end of shaft 44 is disposed within a cap element 52. A set screw 54 passes through the top of the cap element and is screwed into the upper end of the shaft. It will be appreciated that tightening or loosening of the set screw will increase or decrease, respectively, the frictional engagement between the cross piece 40 relative to disk 46 and cap element 52. An arm 56 is integrally affixed to cap element 52 and may be employed to manually turn the cap element, shaft, and disk relative to the cross piece. The cap element, shaft, and disk thus comprise a second connector element movable relative to the first connector element, i.e., the cross piece.

It is to be noted that projections 48, 50 are offset with respect to the axis of rotation of the second connector element, i.e. the longitudinal axis of shaft 44. Therefore, when the second connector element is rotated the positions of the projections are changed vis-a-vis the axis of rotation.

Positioned adjacent to the connector means comprising the first and second connector elements is a rocker 58. Rocker 58 defines an indentation 60 which accommodates a bar 62 attached to the housing in a suitable manner. Rocker 58 is pivotally mounted relative to the bar 62 and the bar provides support for the rocker.

The rocker 58 has a first end 64 which is engageable with a flange 66 comprising part of the reciprocatable pump element 20. As noted above, internal biasing means in the pump continually biases the pump element 20 outwardly and downwardly. This biases rocker 58 in a counter-clockwise direction (as viewed in FIG. 1) and by virtue of the interconnection between the bail and rocker established by the connector means the bail is biased to the position illustrated in FIG. 1 It will be appreciated that upward movement of the rocker first end will urge the pump element in an upward direction. It is also to be understood that the distance the pump element is moved upwardly directly corresponds to the distance moved by the first end.

The rocker 58 includes a second end 70 spaced from the first end. The first and second ends are disposed on opposed sides of the pivot point of the rocker. Second end 70 defines a bearing surface 72 which is disposed below the connector means. Upon depression of the bail distal end 26 by an operator, the connector means will move downwardly as well, with one of the projections 48, 50 engaging the bearing surface 72. Downward movement of the rocker second end 70 will then occur with consequent upper movement of first end 64. The degree of upper movement of first end 64 will of course depend upon how far down the second end 70 is depressed by the engaging projection. By the same token, the degree of upward movement of first end 64 will determine how much liquid is dispensed by pump 18 since, of course, the distance the pump element 20 moves is the determining factor in this regard.

Figure 2A:
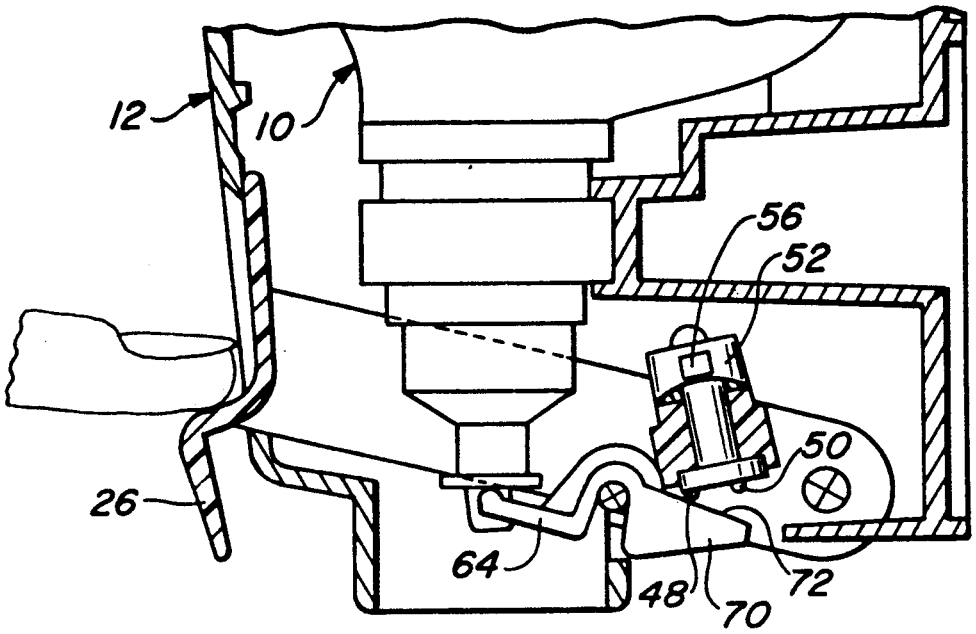
FIGS. 2A and 2B are side elevation views, in partial cross-section, of selected components of the apparatus and illustrating the relative positioning of such components when adjusted for full dispensing and partial dispensing, respectively.
Figure 2B:
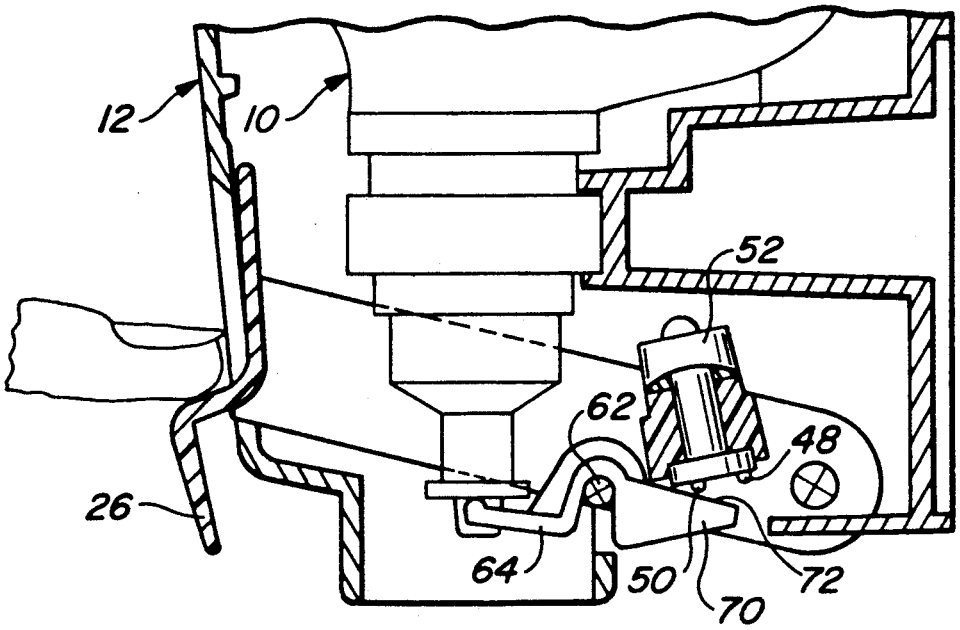
Figure 3:
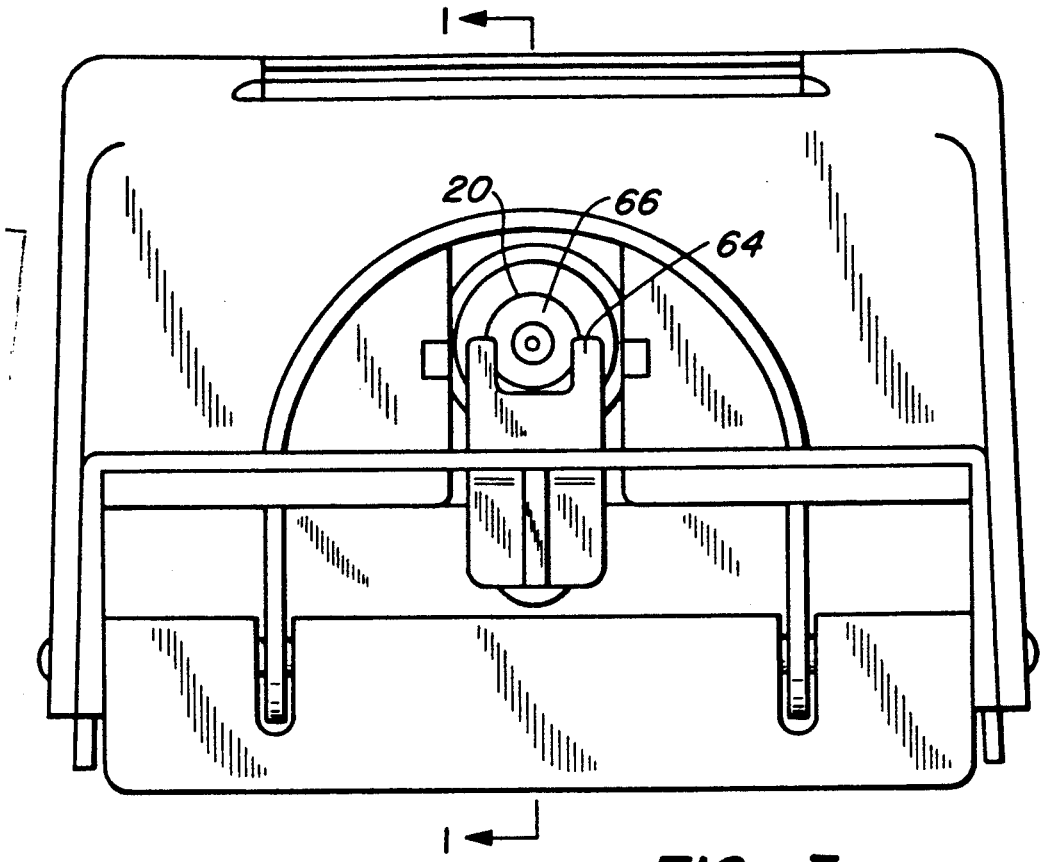
FIG. 3 is a bottom view as taken along the line 3—3 in FIG. 1.
Figure 4:
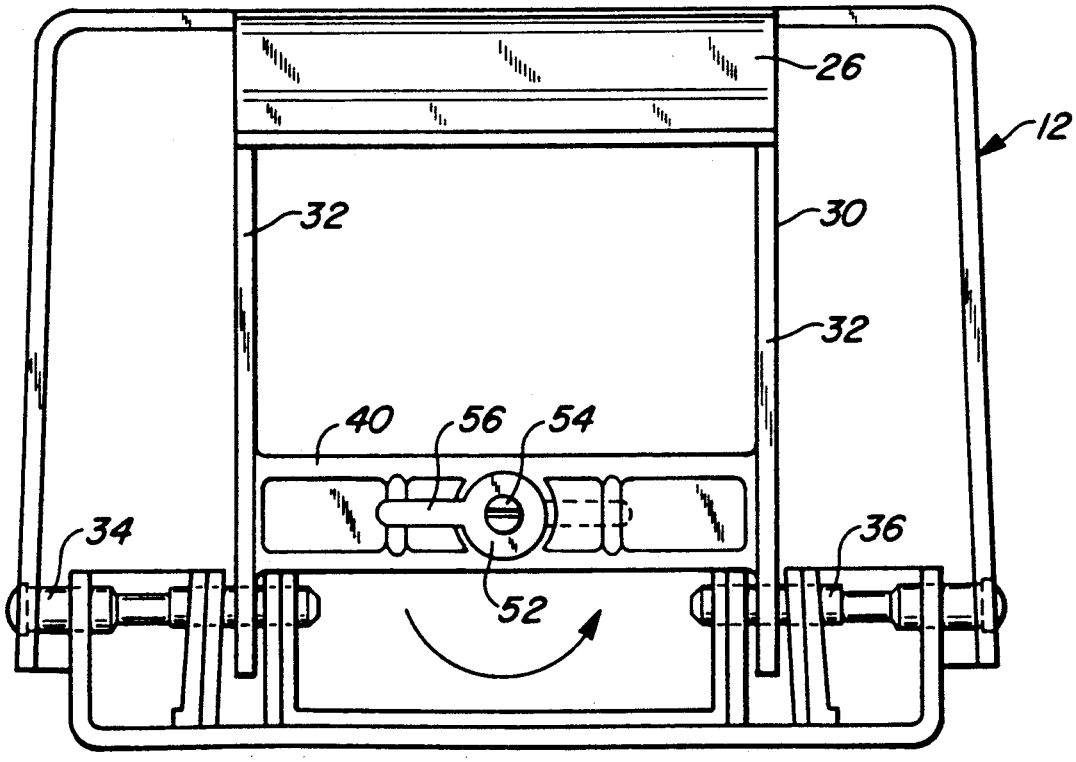
FIG. 4 is a cross-sectional view as taken along the line 4—4 in FIG. 1 with the container removed in the interest of clarity.

Referring now to FIGS. 2A, 2B, it will be seen that when the projection which engages bearing surface 72 is projection 48 the first end 64 of the rocker moves upwardly a greater distance than is the case when the engaging projection is projection 50. That is, when the bail distal end 26 if fully depressed and projection 48 contacts the rocker second end, the pump element 20 will move upwardlY a greater distance than is the case when projection 50 causes rotation of the rocker. This means of course that more liquid will be dispensed from the pump in the former situation than in the latter. In either case, however, the bail will be free to move its full normal extent.

The janitor or other person responsible for maintenance of the dispenser can easily make adjustment of the relative positions of projections 48, 50 once access is had to the interior of the housing. Adjustment is made simply by turning the cap element 52. As noted above, in the arrangement shown, the cap element has an adjustment arm 56 attached thereto which is manually graspable and rotatable to turn the cap element. This also rotates shaft 44 and disk 46 a like degree to reposition the projections relative to the rocker second end. The set screw 54 may be utilized to lock the second connector element against movement relative to the first connector element.

I claim:

1. Apparatus for dispensing liquid comprising, in combination:

a container defining an interior for accommodating liquid;

mounting means for mounting said container;

a pump connected to said container, said pump including a pump element reciprocatable along a predetermined path of movement to dispense liquid from said housing interior; and actuator means operatively associated with said pump for moving said pump element along said predetermined path of movement, said actuator means including manually operable bail means movably connected to said mounting means and movable from a first position to a second position, rocker means pivotally attached to said mounting means at a pivot point on said rocker means, said rocker means having a first end engageable with said pump element to move said pump element along said predetermined path of movement upon pivotal movement of said rocker means, and connector means interconnecting said bail means and rocker means to impart pivotal movement to said rocker means responsive to movement of said bail means from said first position to said second position, said connector means including adjustment means for selectively varying the degree of pivotal movement imparted to said rocker means by said bail means during movement of said bail means from said first position to said second position whereby the distance said pump element is moved along said predetermined path by said rocker means first end when said bail means is moved from said first position to said second position may be selectively varied.

2. The combination according to claim 1 wherein said rocker means includes a second end spaced from said first end, said first and second ends being disposed on opposed sides of said pivot point and said second end defining a bearing surface, said connector means being affixed to said bail means and movable therewith while in engagement with said bearing surface.

3. The combination according to claim 2 wherein said connector means includes projection means engaging said bearing surface, said adjustment means comprising means for varying the location of said projection means relative to the rocker means pivot point.

4. The combination according to claim 3 wherein said projection means comprises a plurality of discrete projections separately selectively engageable with said bearing surface.

5. The combination according to claim 3 wherein said connector means includes a first connector element affixed to said bail means and a second connector element selectively positionable relative to said first connector element, said second connector element at least partially comprising said projection means.

6. The combination according to claim 5 including locking means for selectively locking said second connector element against movement relative to said first connector element.

7. The combination according to claim 5 wherein said second connector element is rotatably mounted relative to said first connector element about an axis of rotation, said projection means comprising at least one projection offset with respect to said axis of rotation.

8. Actuator means for dispensing liquid from the interior of a container mounted on mounting means and having a pump connected thereto, said pump including a pump element reciprocatable along a predetermined path of movement to dispense liquid from said housing interior, said actuator means comprising, in combination:

manually operable bail means movably connected to said mounting means and movable from a first position to a second position;

rocker means pivotally attached to said mounting means at a pivot point on said rocker means, said rocker means having a first end engageable with said pump element to move said pump element along said predetermined path of movement upon pivotal movement of said rocker means; and connector means interconnecting said bail means and rocker means to impart pivotal movement to said rocker means responsive to movement of said bail means from said first position to said second position, said connector means including adjustment means for selectively varying the degree of pivotal movement imparted to said rocker means by said bail means during movement of said bail means from said first position to said second position whereby the distance said pump element is moved along said predetermined path by said rocker means first end when said bail means is moved from said first position to said second position may be selectively varied.

* * * * *